US011001420B2

(12) United States Patent
Gabriel

(10) Patent No.: US 11,001,420 B2
(45) Date of Patent: May 11, 2021

(54) SMART LIQUID CONTAINER

(71) Applicant: Gameel Gabriel, Covington, LA (US)

(72) Inventor: Gameel Gabriel, Covington, LA (US)

( * ) Notice: Subject to any disclaimer, the term of this patent is extended or adjusted under 35 U.S.C. 154(b) by 0 days.

(21) Appl. No.: 16/141,537

(22) Filed: Sep. 25, 2018

(65) Prior Publication Data

US 2020/0095032 A1 Mar. 26, 2020

(51) Int. Cl.
*B65D 47/20* (2006.01)
*B65D 25/56* (2006.01)
*B65D 25/28* (2006.01)

(52) U.S. Cl.
CPC ..... *B65D 47/2012* (2013.01); *B65D 25/2894* (2013.01); *B65D 25/56* (2013.01); *B65D 2203/04* (2013.01); *B65D 2205/02* (2013.01); *B65D 2547/066* (2013.01)

(58) Field of Classification Search
CPC ..... B65D 47/2012; B65D 25/2894; B65D 25/56; B65D 47/261; B65D 47/263; B65D 47/065; B65D 47/46; B65D 25/38–50; B67D 3/043–048; B67D 7/005
See application file for complete search history.

(56) References Cited

U.S. PATENT DOCUMENTS 1,230,207 A * 6/1917 Norman ..... B65D 47/263 222/484
1,509,431 A * 9/1924 Hill ..... B65D 47/242 222/520
1,537,399 A * 5/1925 Wiswell ..... B65D 47/263 222/536
1,555,176 A * 9/1925 Allen ..... B65D 47/065 222/154
1,555,383 A * 9/1925 Ramslie ..... B65D 47/261 220/361
1,617,992 A * 2/1927 Drake ..... B65D 47/265 222/466
1,729,839 A * 10/1929 Meggitt ..... B65D 47/065 222/475

(Continued)

FOREIGN PATENT DOCUMENTS

DE 3514132 * 10/1986

OTHER PUBLICATIONS

Invert _ Definition of Invert by Merriam-Webster, Feb. 14, 2020.*

*Primary Examiner* — Paul R Durand
*Assistant Examiner* — Randall A Gruby
(74) *Attorney, Agent, or Firm* — Kenneth L. Tolar

(57) ABSTRACT

This invention provides a liquid container apparatus and method to prevent spilling of a liquid, such as oil, while adding liquid to an engine or other component, without the use of a funnel and without inverting the container, and to make the liquid-adding operation easier and safer for a user, providing a smart cap with a smart-cap opening turnably mounted upon an opening protrusion on a container body such that the smart cap can be closed and opened without detaching the smart cap from the container body, the liquid can be dispensed without inverting the container, and the rate of liquid flow can be controlled by a user, providing a container able to be placed upon or near an engine for the required time, providing a container that dispenses liquid without being inverted, and providing a container that visually indicates the amount of liquid within, consequently simplifying the use of the container.

11 Claims, 5 Drawing Sheets

(56) References Cited

U.S. PATENT DOCUMENTS 1,761,477 A * 6/1930 Kahle ..... B65D 47/265 222/536
2,022,343 A * 11/1935 Drood ..... B65D 47/065 222/484
2,121,890 A * 6/1938 Sprigings ..... B65D 47/065 222/536
2,138,060 A * 11/1938 Conner ..... B65D 47/246 222/540
2,168,607 A * 8/1939 O'Brien ..... B65D 47/265 222/498
2,168,608 A * 8/1939 O'Brien ..... B65D 47/065 222/498
2,455,769 A * 12/1948 Hermani ..... B65D 25/46 222/482
2,668,642 A * 2/1954 Johannesen ..... B65D 47/265 222/484
2,782,967 A * 2/1957 Walker ..... B65D 47/065 222/485
2,816,695 A * 12/1957 Dagenais ..... B65D 47/065 222/481
3,198,406 A 8/1965 Kopelman
3,734,360 A * 5/1973 Brown ..... B65D 47/20 222/537
4,376,497 A * 3/1983 Mumford ..... B65D 50/046 215/216
4,544,063 A * 10/1985 Neward ..... B65D 47/263 206/528
4,781,314 A * 11/1988 Schoonover ..... B65D 1/18 215/375
4,887,746 A * 12/1989 Dubach ..... B65D 47/122 222/519
D325,871 S * 5/1992 Hestehave ..... D9/520
5,111,970 A * 5/1992 Rutter ..... B67D 3/047 222/105
D337,234 S * 7/1993 McGinnis ..... D7/306
D341,514 S * 11/1993 McGinnis ..... D7/306
5,277,343 A * 1/1994 Parsonage ..... B65D 25/50 222/484
5,303,850 A * 4/1994 Connan ..... B65D 47/263 215/253
D370,379 S * 6/1996 Klein ..... D7/306
5,671,868 A * 9/1997 Herr ..... B65D 25/46 141/1
5,884,802 A * 3/1999 Leibowitz ..... B65D 25/2882 220/771
D418,759 S * 1/2000 Holmstrom ..... D9/528
6,082,591 A 7/2000 Healey
6,494,344 B1 12/2002 Kressel, Sr.
6,848,602 B2 * 2/2005 deCler ..... B67D 3/045 222/105
7,900,796 B2 * 3/2011 Ungrady ..... B65D 1/40 215/383
D668,546 S * 10/2012 Maas ..... D9/528
8,365,939 B2 * 2/2013 Dygert ..... B65D 1/20 215/398
8,910,835 B2 * 12/2014 Ouderkirk ..... B67D 7/04 222/484
9,714,123 B2 7/2017 Agassi et al.
9,807,976 B2 * 11/2017 Taylor ..... A01K 1/0114
9,809,353 B2 * 11/2017 Gieske ..... B65D 25/2894
9,845,171 B2 * 12/2017 Conway ..... B65D 25/2882
10,280,065 B2 * 5/2019 Shaw ..... B65D 1/20
2003/0062329 A1 * 4/2003 Alley ..... B65D 47/263 215/307
2016/0137361 A1 5/2016 Snow et al.
2017/0283135 A1 10/2017 Lemarchand

* cited by examiner

SMART LIQUID CONTAINER

BACKGROUND OF THE INVENTION

This invention provides a smart liquid container apparatus and method providing for opening and closing a smart cap without detaching the smart cap from the container body.

The prior art does not provide for an oil container, or a related liquid container, apparatus and method providing a smart cap with a smart-cap opening turnably mounted upon an opening protrusion on a container body such that the smart cap can be closed and opened without detaching the smart cap from the container body, consequently preventing misplacement or loss of the smart cap and simplifying the use of the container. With the currently available fluid (e.g., motor oil, anti-freeze, transmission oil, etc.) containers on the market today, when the user needs to add fluid to the engine, for example, he or she must either use a funnel to avoid spilling of the liquid or make their best effort to prevent the liquid from spilling during the pouring process; but unfortunately, more often than not, the liquid will spill and contaminate other components of the engine. While this is seemingly a benign issue, it may certainly result in a disastrous outcome for the user or even others. For instance, if oil spill contaminates the alternator, then the spilled oil might ruin the alternator. Aside from the cost and inconvenience of replacing a ruined part, the malfunction of the alternator will cause the vehicle to stall, and perhaps without warning. Moreover, if such an incident occurs in a high traffic and/or high-speed area, it could result in serious or fatal injuries to the operator of the vehicle and others as well.

For example, U.S. Pat. No. 9,714,123 for a "Dispensing Closure," issued on Jul. 25, 2017 to assignee Again Innovations Ltd., provides for a dispensing closure for covering an opening of a container including a liquid. The dispensing closure includes an engagement element that fits over the opening of the container and defines a pouring orifice for allowing pouring of the liquid. The pouring orifice having a side defining an air channel for allowing air to flow into the container when liquid during the pouring. The engagement element also includes outer walls and a cap having a hollow including inner walls tightly conforming to the outer walls, a first orifice generally conforming in shape to the pouring orifice, and a second orifice generally conforming in shape to the air channel.

U.S. Pat. No. 6,494,344 for a "Liquid Dispensing Container," issued on Dec. 17, 2002 to inventor Joseph A. Kressel, Sr., provides for a liquid dispensing container for conveniently storing and dispensing various types of fluids. The liquid dispensing container includes a container capable of storing a volume of fluid, a strap attached to an upper surface of the container, a fill cap removably attached to a threaded nipple, a transparent or semi-transparent viewing portion within at least one side of the container, a dispensing hose fluidly connected to a lower portion of the container, a dispensing nozzle attached to the end of the dispensing hose, and a clasp attached to the container for catchably receiving the dispensing hose. A plurality of marker lines and relevant indicia are preferably positioned adjacent the viewing portion which has an elongate vertical structure thereto for allowing an individual to determine the amount of fluid within or dispensed from the container. The dispensing hose and the nozzle are preferably comprised of a relatively smaller structure for allowing the individual to fit the nozzle into compact areas.

U.S. Pat. No. 6,082,591 for a "Graduated Sight Glass Container," issued on Jul. 4, 2000 to inventor Thomas J. Healey, provides for a graduated sight glass container for retaining a substance therein and minimizing the possibility of spillage during dispensing of the substance therefrom. The graduated sight glass container includes a housing having a shape of a quadrilateral and including an indented section on a first side thereof. A spout is connected to extend from the indented section of the housing and at most up to the first side. A pool is formed within the indented section and surrounding the spout, wherein, when the container is tilted from a vertical at-rest position causing the spout to be positioned adjacent an opening through which the substance contained within the container is to flow, the pool is caused to at least partially receive an edge of the opening. Extending along a second side of the housing is a first graduated scale and a second graduated scale extends along a base of the housing for measuring an amount of the substance within said container and an amount of the substance dispensed from the container during dispensing. The first and second graduated scales are both made of a clear material allowing a user to view the substance within the container therethrough and include indicia printed therealong indicative of a volume of said container at predetermined positions.

U.S. Pat. No. 3,198,406 for a "Dispenser Cap with Deformable Cone Assembly," issued on Aug. 3, 1965 to inventor Ahron W. Kopelman, provides for a dispenser cap having controllable valve means for dispensing liquids or pastes from a container, and more particularly, a dispenser cap comprising an outer cap rotatably retained on an inner cap, the outer cap having a resiliently expandable conical sleeve to permit assembly to be achieved by elastic deformation.

U.S. Patent Application Publication No. 2017/0283135 for a "Container for Viscous Liquid Comprising a Cap Provided with a Tap," published on Oct. 4, 2017 by applicant Total Marketing Services, discloses a container including an upper wall, a lower wall, and a side wall defining an inner space, a single opening extending along a main axis, a cap including a flow duct provided with an outlet extending along an axis substantially perpendicular to the main axis, and a pipe including a first end in fluid communication with the outlet and a second end intended for extending above the level of the liquid in the container, the pipe being rotatably secured with the cap and extending essentially along a tilted axis forming an angle of 25° to 75° with the main axis and having a length no less than half the length of the container.

U.S. Patent Application Publication No. 2016/0137361 for a "No Spill Cap Assembly," published on May 19, 2016 by inventors Gary Lee Snow et al., discloses a cap assembly connected to a container for dispensing the contents of the container that includes an inner cap and an outer cap. The inner cap includes a cylindrical inner cap surface between a proximal end and a distal end that includes an inner cap opening. The outer cap is positioned over and secured to the inner cap. The outer cap includes a cylindrical outer cap surface between the proximal end and distal end, and the cylindrical outer cap surface includes an outer cap opening. The cap assembly includes an open configuration and a closed configuration. The outer cap can be rotated about the inner cap between the open configuration and the closed configuration.

U.S. Pat. No. 1,555,383 for a "Spout Can," issued on Sep. 29, 1925 to inventor Harold Ramslie, provides for a spout can, specifically claiming a venting means for a can comprising a flat strip secured at one end only to the outside of the can, a pointer pivotally secured to the free end of the flat strip adapted to lie flat against the outside of the can or turn in its pivotal connection to a position at right angles to the can.

Lastly, U.S. Pat. No. 2,022,343 for a "Pouring Means for Canisters," issued on Nov. 26, 1935 to inventor Harry Drood, provides a filling opening closure for a liquid container can, the closure being of a formation and adapted for assembly with a rotatable pouring spout, the device being adapted for either the top or the bottom wall of the can.

What is needed is a liquid container that can be opened and closed without detaching a cap from a container body, preventing misplacement or loss of the cap, and simplifying the use of the container.

SUMMARY OF THE INVENTION

This invention provides a liquid container apparatus and method to prevent spilling of a liquid, such as oil, while adding liquid to an engine or other component, without the use of a funnel and without inverting the container, and to make the liquid-adding operation easier and safer for a user, providing a smart cap with a smart-cap opening turnably mounted upon an opening protrusion on a container body such that the smart cap can be closed and opened without detaching the smart cap from the container body, the liquid can be dispensed without inverting the container, and the rate of liquid flow can be controlled by a user, providing a container able to be placed upon or near an engine for the required time, providing a container that dispenses liquid without being inverted, and providing a container that visually indicates the amount of liquid within, consequently simplifying the use of the container.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
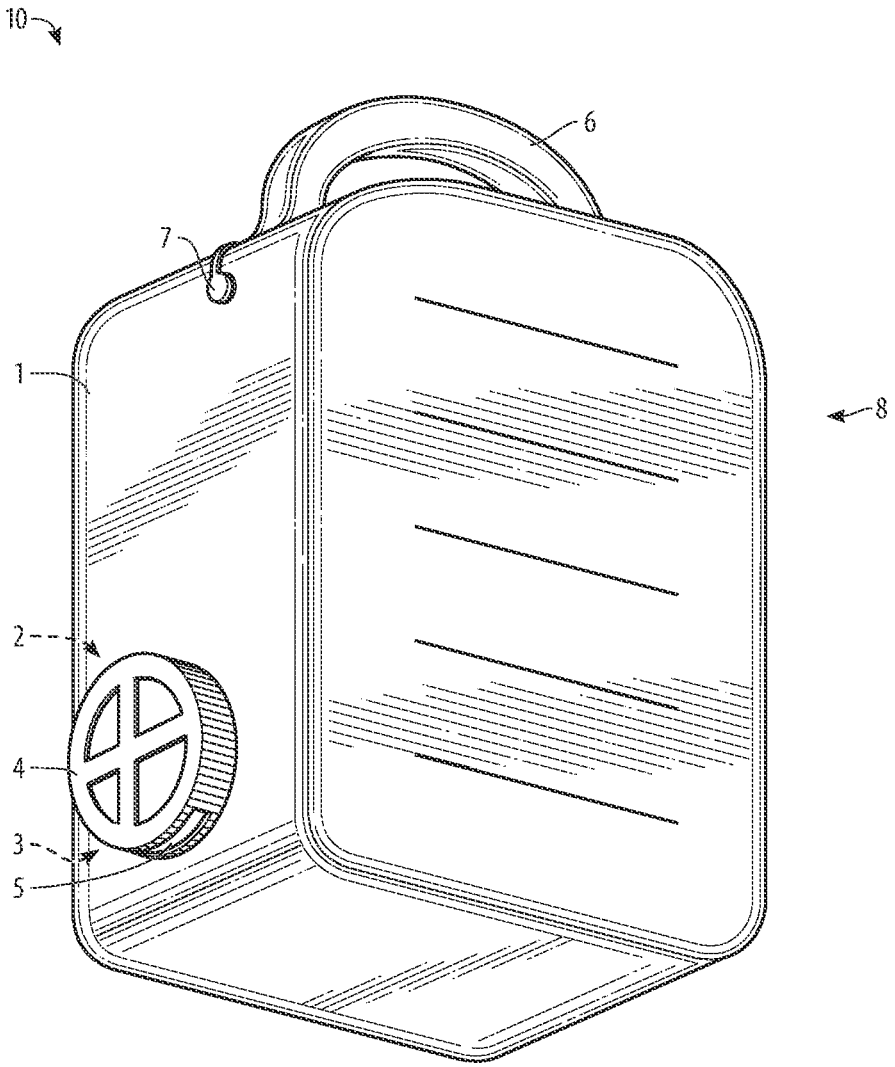
FIG. 1 is a bottom perspective view of the smart liquid container of the invention.

Referring to FIG. 1, the smart liquid container 10 apparatus of the invention comprises a container body 1 to safely hold oil and similar heavy, viscous liquids, having a top, bottom, and sides, with a container handle 6 at or near the top of the container body, for safe carrying and manipulating of the container, and having, optionally, volume indicators 8 showing the volume of oil or similar fluids in the container. Also, at or near the top of the container body is placed a sealable air vent 7, which, when opened, prevents any vacuum lock from hampering the flow of liquid. The container body 1 is made of a clear or translucent material allowing a user to visually ascertain the volume of liquid within the container by reference to the volume indicators 8. The container body 1 is of a shape that allows resting or temporary placement of the smart liquid container 10 upon or near the engine, above the engine's liquid inlet such as an oil inlet. The container body 1, especially at the bottom should be able to withstand the consequent heat of the engine, and the bottom should have a flat, stable profile.

Figure 2:
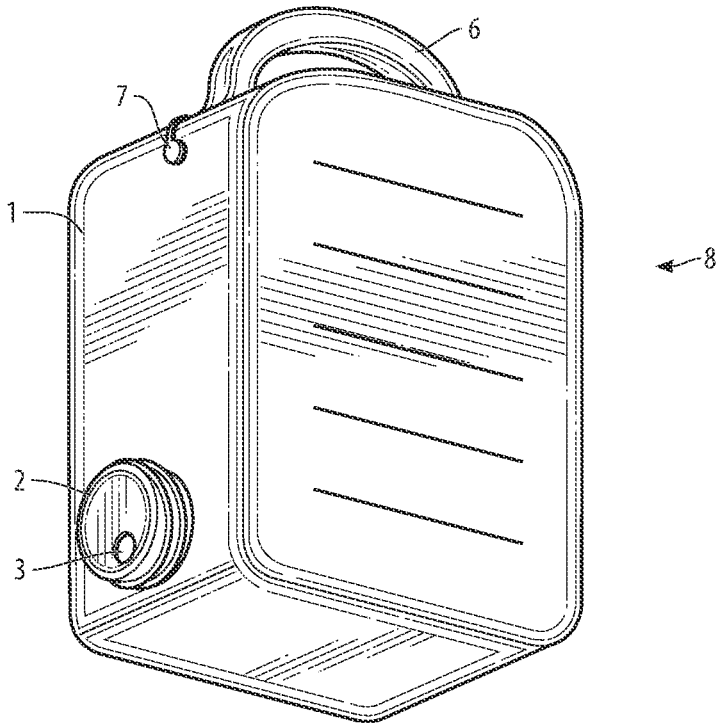
FIG. 2 is a bottom perspective view of the container body of the smart liquid container of the invention.

Referring additionally to FIG. 2, on a side, and near the bottom of the container body is placed an opening protrusion 2 having threads which tend to pull an encircling object closer or push it away when turned in different directions. Upon the opening protrusion 2 is placed a body opening 3 which, when unsealed, allows the flow of liquid out of the container body 1.

Figure 3:
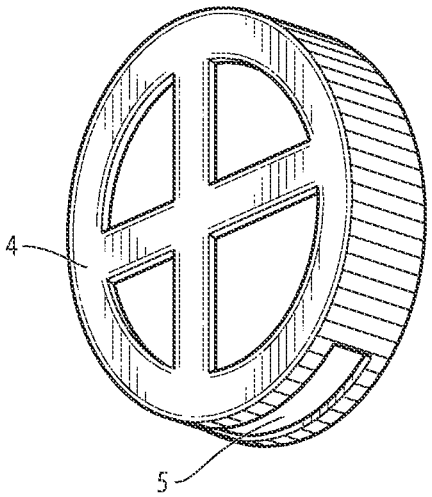
FIG. 3 is a bottom perspective view of the smart cap of the smart liquid container of the invention.

Referring additionally to FIG. 3, a smart cap 4 is provided to be mounted upon the opening protrusion 2 such that, when turned in one direction, the smart cap is pulled toward the container body, and the body opening 3 is sealed, preventing the flow of liquid; and when turned in the opposite direction, the smart cap is pushed away from the container body, and the body opening 3 is unsealed, allowing the flow of liquid. A smart-cap opening 5 is provided to allow liquid flowing from the body opening 3 to pass out of the smart cap 4 when the smart cap 4 is in an open position.

Figure 4:
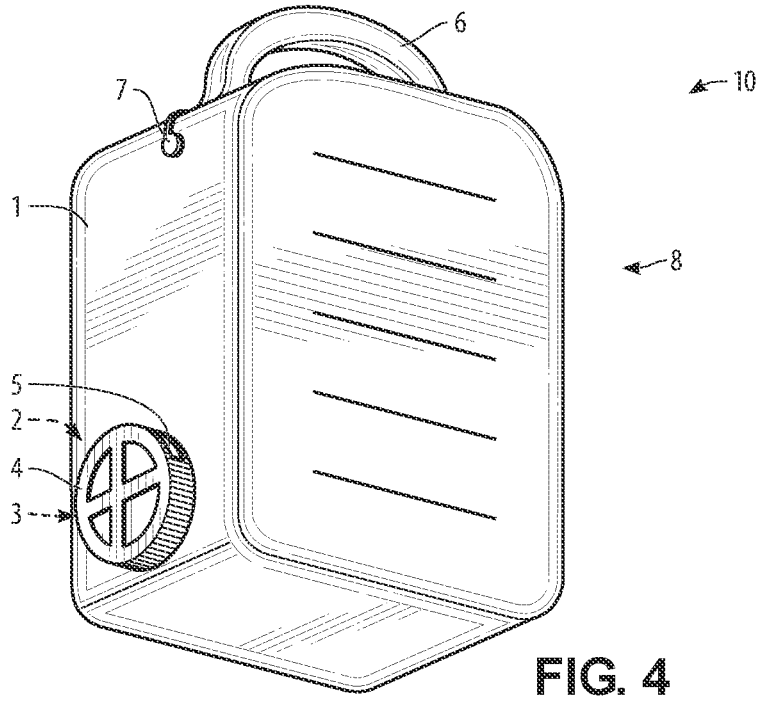
FIG. 4 is a bottom perspective view of the smart liquid container of the invention, in use, closed.
Figure 5:
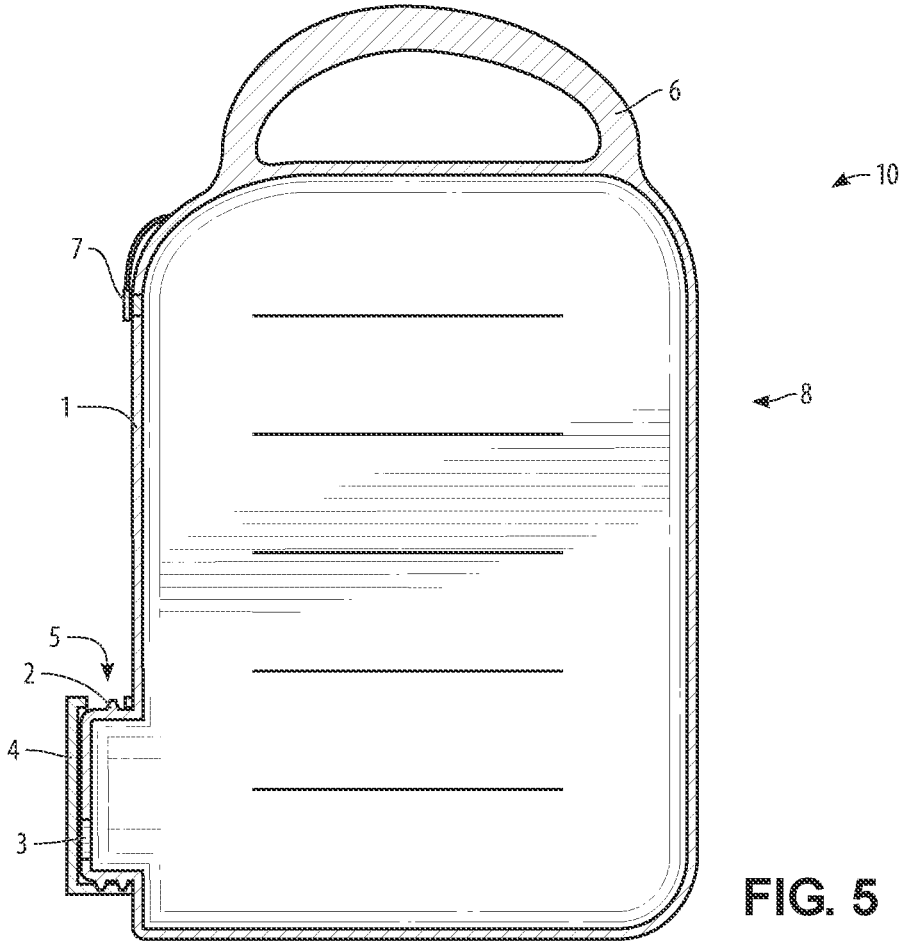
FIG. 5 is a section view of the smart liquid container of the invention, in use, closed.

Referring to FIG. 4 and FIG. 5, in use in a closed position, the smart cap 4 is held tight against, and blocks or seals, the body opening 3 in the opening protrusion 2. The smart-cap opening 5 therefore cannot pass any liquid, and the location of the smart-cap opening does not have any effect upon the non-existent flow of liquid.

Figure 6:
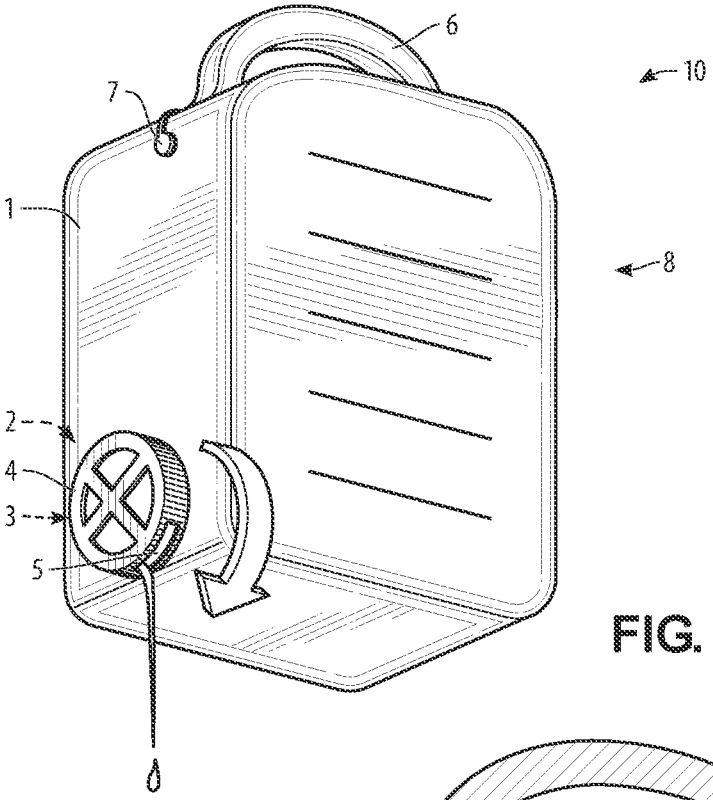
FIG. 6 is a bottom perspective view of the smart liquid container of the invention, in use, opening.
Figure 7:
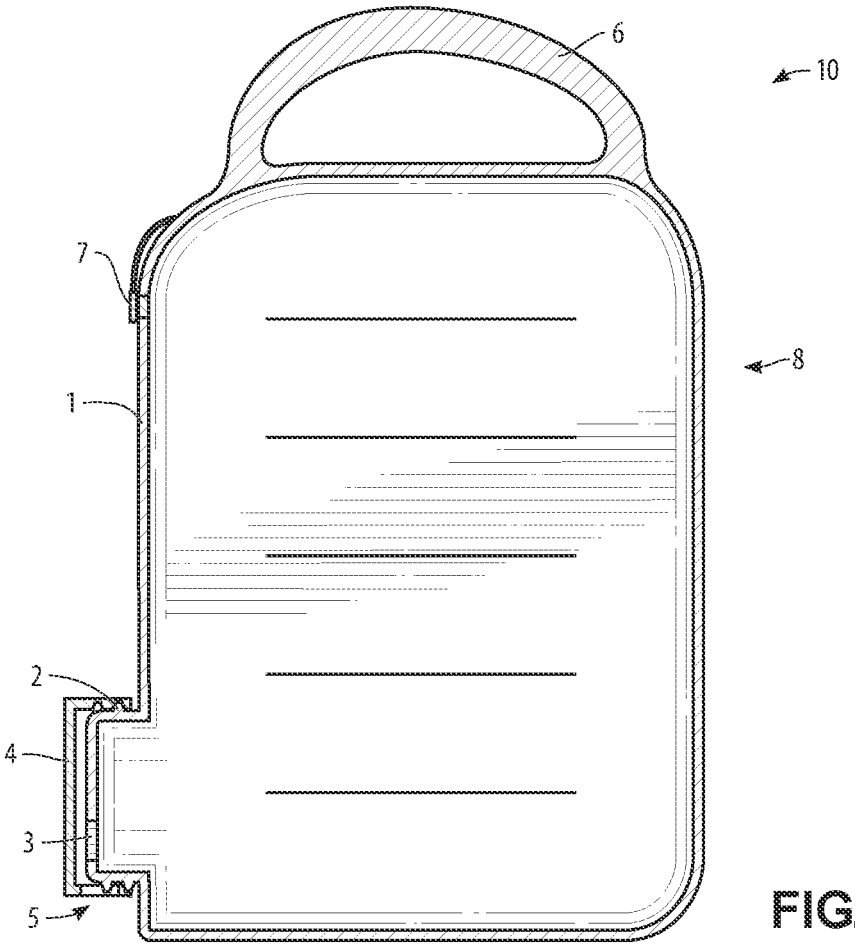
FIG. 7 is a section view of the smart liquid container of the invention, in use, opening.

Referring to FIG. 6 and FIG. 7, in use in a partially open position, the smart cap 4 is moved slightly away from the body opening 3 in the opening protrusion 2, and a partial flow of liquid is allowed. The smart-cap opening 5 moves into a position allowing a partial flow of liquid through the smart cap 4. This allows a user to control the rate of outflow of the liquid.

Figure 8:
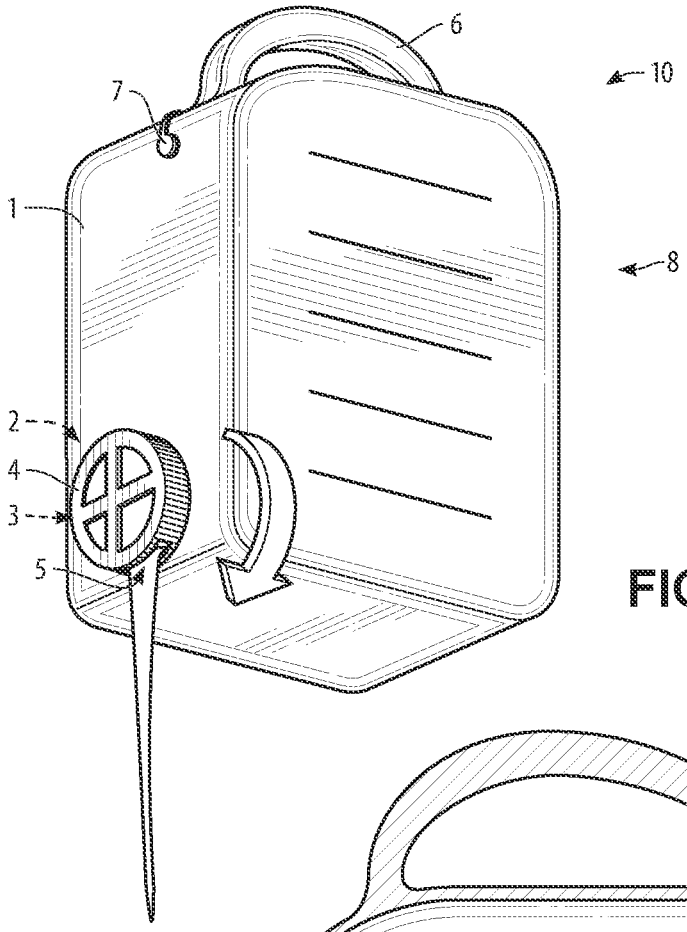
FIG. 8 is a bottom perspective view of the smart liquid container of the invention, in use, open.
Figure 9:
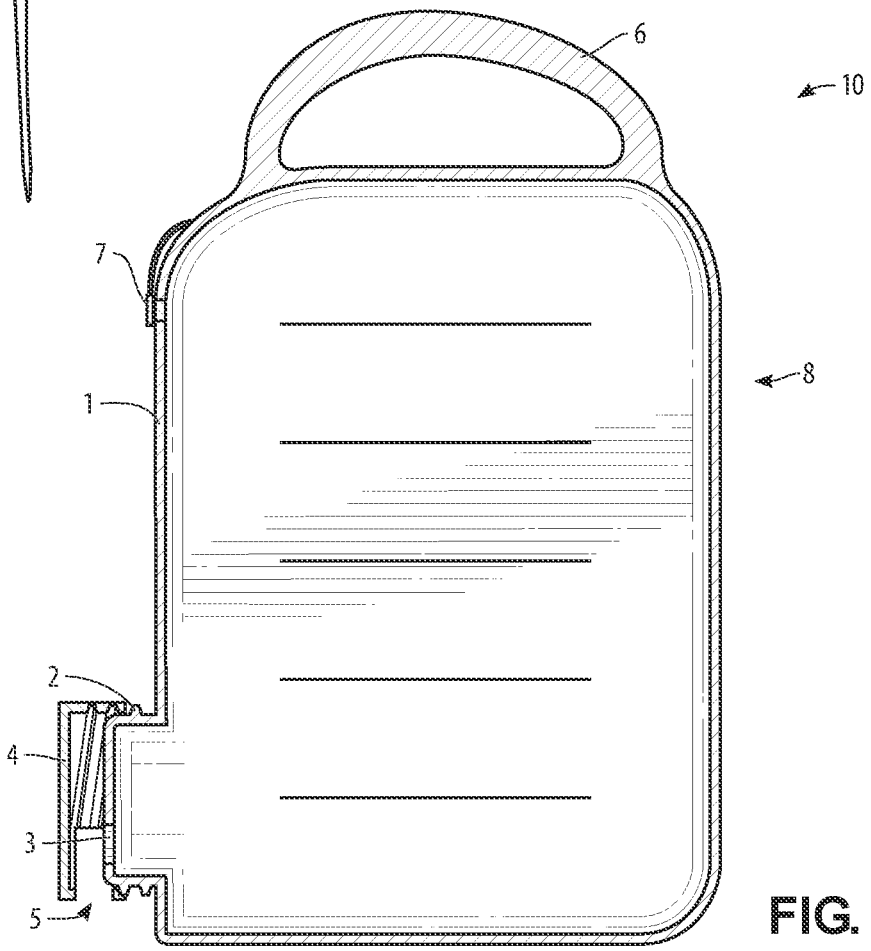
FIG. 9 is a section view of the smart liquid container of the invention, in use, open.

Referring to FIG. 8 and FIG. 9, in use in a fully open position, the smart cap 4 is moved farther away from the body opening 3 in the opening protrusion 2, and a full flow of liquid is allowed. The smart-cap opening 5 moves into a position allowing a full flow of liquid through the smart cap 4.

During use, the smart cap 4 is not removed from the opening protrusion 2 of the container body 1. The smart cap 4 is easily, conveniently, and safely manipulated to deliver a precise flow of liquid, even in awkward positions; and the smart cap 4 cannot be misplaced but is always at hand to be turned again to stop or modulate the flow of liquid.

Many other changes and modifications can be made in the system and method of the present invention without departing from the spirit thereof. I therefore pray that my rights to the present invention be limited only by the scope of the appended claims.

I claim:

1. A smart liquid container apparatus comprising:

(i) a container body having a top surface, a bottom, and a side wall, adapted to safely hold liquid and contain a flow of contents;

(ii) a container handle at extending above the top surface of said container body, the container body having an upright orientation with the container handle extending upwardly from the top surface;

(iii) a sealable air vent near the top surface of said container body;

(iv) an opening protrusion extending from a side wall of said container body near the bottom of the side wall, the protrusion having exterior threads;

(v) a body opening flush with an outer face of said opening protrusion and positioned near a lower circumference thereof;

(vi) a smart cap rotatably mounted upon said opening protrusion, the smart cap having a tubular rim with internal threads that mate with the exterior threads of said opening protrusion, said smart cap adapted for sealing said body opening against the flow of contents out of said container body in a closed position; and (vii) a smart-cap slot formed on and flush with an outer surface of the tubular rim of said smart cap and circumferentially extending along a lower portion of said tubular rim, said smart-cap slot below and aligning with the body opening to allow the flow of contents out of said container body when said smart cap is in an open position, while the container body remains in the upright orientation; where, in use, the placement of said smart cap and smart-cap opening in a closed position moves said smart-cap slot above said body opening to prevent the flow of contents out from said container body, and the placement of said smart cap and smart-cap opening in an open position allows the flow of contents out from said container body, while the smart cap remains engaged with the container body.

2. The smart contents container apparatus of claim 1, further comprising volume indicators placed upon said container body.

3. The smart contents container apparatus of claim 2 wherein said container apparatus is translucent to allow a user to visually ascertain a volume of contents therein.

4. The smart contents container apparatus of claim 1, further comprising said container body made of plastic.

5. The smart contents container apparatus of claim 1, further comprising said container body made of HDPE plastic.

6. The smart contents container apparatus of claim 1, further comprising said container body made of metal.

7. The smart contents container apparatus of claim 1, further comprising said container body adapted to hold substantially 5 gallons or 19 liters.

8. The smart contents container apparatus of claim 1, further comprising said container body having a planar exterior bottom surface adapted to facilitate for increased stability of the container body.

9. The smart contents container apparatus of claim 1, wherein the smart cap further comprises a closing plate attached to an outer periphery of the tubular rim of the smart cap and adapted to prevent the flow of contents from said container body while the smart cap is in the closed position.

10. The smart contents container apparatus of claim 1, wherein the smart cap opening is configured to form a downwardly-facing opening when the smart cap is in the open position.

11. The smart contents container apparatus of claim 1 wherein said body opening has a horizontal central axis and said smart cap slot has a vertical central axis.

* * * * *